US011529599B1

(12) United States Patent
Springer et al.

(10) Patent No.: US 11,529,599 B1
(45) Date of Patent: Dec. 20, 2022

(54) ELECTROMECHANICAL VALVE SEQUENCING FOR FLUID MIXTURE DISPENSING DEVICES

(71) Applicant: Cana Technolog, Inc., Redwood City, CA (US)

(72) Inventors: Gregory Allen Springer, Los Altos, CA (US); Stephan Weidi Tai, San Francisco, CA (US); Dale Word, Chico, CA (US); Sean McCommons, San Francisco, CA (US)

(73) Assignee: Cana Technology, Inc., Redwood City, CA (US)

( * ) Notice: Subject to any disclaimer, the term of this patent is extended or adjusted under 35 U.S.C. 154(b) by 0 days.

(21) Appl. No.: 17/549,364

(22) Filed: Dec. 13, 2021

(51) Int. Cl.

| | |
|---|---|
| ***B01F 35/00*** | (2022.01) |
| ***B01F 35/71*** | (2022.01) |
| ***B01F 33/84*** | (2022.01) |
| ***B01F 35/221*** | (2022.01) |
| ***B67D 1/00*** | (2006.01) |
| ***B67D 1/12*** | (2006.01) |
| *B01F 23/40* | (2022.01) |
| *B01F 101/14* | (2022.01) |
| *B01F 101/16* | (2022.01) |
| *B01F 101/21* | (2022.01) |

(52) U.S. Cl.
CPC ..... *B01F 35/71805* (2022.01); *B01F 33/846* (2022.01); *B01F 35/22162* (2022.01); *B67D 1/0037* (2013.01); *B67D 1/1277* (2013.01); *B01F 23/483* (2022.01); *B01F 2101/14* (2022.01); *B01F 2101/16* (2022.01); *B01F 2101/21* (2022.01)

(58) Field of Classification Search
CPC ..... B01F 35/71805; B01F 35/22162; B01F 33/846; B67D 1/0037; B67D 1/1277
See application file for complete search history.

(56) References Cited

U.S. PATENT DOCUMENTS

| | | | | |
|---|---|---|---|---|
| 7,156,259 | B2 * | 1/2007 | Bethuy | B67D 1/1455 222/59 |
| 7,357,493 | B2 | 4/2008 | Silverbrook et al. | |
| 8,181,822 | B2 | 5/2012 | Doelman et al. | |

(Continued)

FOREIGN PATENT DOCUMENTS

| | | | |
|---|---|---|---|
| WO | 2013176921 | A1 | 11/2013 |
| WO | 2018064454 | A1 | 4/2018 |

*Primary Examiner* — Anshu Bhatia
(74) *Attorney, Agent, or Firm* — Daylight Law, P.C.

(57) ABSTRACT

Systems and methods for reducing the overall current draw of a fluid mixture dispensing device are disclosed. A disclosed system includes a mixing area, a set of ingredient reservoirs, and a set of electromechanical valves. The set of electromechanical valves are in a one-to-one correspondence with the set of ingredient reservoirs, and fluidly connect the set of ingredient reservoirs and the mixing area during a respective set of dispense times. The system further includes a controller programmed to actuate at least two valves from the set of electromechanical valves to dispense, to the mixing area, at least two ingredients from the ingredient reservoirs associated with the at least two valves. The controller is programmed to actuate the at least two valves in sequence with partially overlapping dispense times and without overlapping opening times.

27 Claims, 8 Drawing Sheets

(56) References Cited

U.S. PATENT DOCUMENTS

| | | | | |
|---|---|---|---|---|
| 8,788,090 | B2 * | 7/2014 | Rothschild | G07F 13/06 700/239 |
| 8,857,667 | B2 | 10/2014 | Nevarez et al. | |
| 9,593,005 | B2 | 3/2017 | Jersey et al. | |
| 10,689,239 | B1 | 6/2020 | Siegel | |
| 2007/0021468 | A1 | 1/2007 | Annis | |
| 2017/0354941 | A1 * | 12/2017 | Brown | B01F 25/30 |

* cited by examiner

ELECTROMECHANICAL VALVE SEQUENCING FOR FLUID MIXTURE DISPENSING DEVICES

BACKGROUND

Typical beverage dispensing systems combine a diluent (e.g., water) with a basic beverage component such as concentrates, or syrups made up of a multitude of other ingredients. However, these basic beverage components often require significant storage space and may even need to be kept refrigerated to protect against spoilage. Accordingly, these basic beverage components are most likely not even stored in the same room as the dispenser, much less in the dispensing container itself. In addition, each individual beverage may require its own unique basic beverage component thereby further increasing storage space and the overall footprint of the beverage dispensing system. Furthermore, typical beverage dispensing systems cannot allow for customization of the beverage as well as household usage.

SUMMARY

This disclosure relates generally to fluid mixture dispensing systems and methods, and more specifically, to electromechanical valves used in fluid mixture dispensing systems and associated methods.

Fluid mixture dispensing can be accomplished by an automated fluid mixture dispensing system. Such systems can generate mixtures of beverages, cleaning products, cosmetic compounds, and various other fluid mixtures. Based on a user selection that is custom tailored by them, the system can prepare and dispense a variety of fluid mixtures, based on a set of basic mixtures and compounds. The system can rely on the predefined chemical makeup of the fluid mixture in order for the system to prepare the mixture. For example, chemical analysis of a specific wine or perfume results in a list of chemical ingredients or components that make up the specific wine or perfume. The systems disclosed herein can rely on that predetermined list of chemical ingredients for a specific final, user specified fluid mixture (e.g., chardonnay) to prepare that fluid mixture. Some chemical ingredients may be dispensed in the final mixture with relatively large volume percentages (e.g., a glass of wine may have about 10-15% ethanol), whereas other components may be dispensed in volume of less than 0.1 mL. Because a small quantity (e.g., less than 0.1 mL) of an individual chemical ingredient can have a large effect on a fluid mixture property (e.g., taste), the overall storage or footprint of the system can be significantly smaller than those dispensing system that which rely on syrups and/or concentrates.

FIG. 1 illustrates an example of a fluid mixture dispensing system in the form of a device 100, in accordance with specific embodiments of the invention. In some embodiments, the fluid mixture dispensing device 100 can be used for beverage dispensing as well as a wide variety of other fluid mixture dispensing. The fluid mixture dispensing device 100 can be a countertop or consumer electronic device or a larger device installed in a restaurant or other commercial business. Fluid mixture dispensing device 100 can include a casing 102. The casing can be a protective outer casing that houses various internal components of the system, such as the components illustrated in FIG. 2. Fluid mixture dispensing system 100 can also include a user interface 103 so that a user can control the device. For example, a user can select a beverage to be made by device 100 via the user interface 103. Fluid mixture dispensing system 100 can also include one or more controllers configured to execute instructions to control the various components of the device and to cause the device to perform the functions described in this disclosure.

FIG. 2 illustrates examples of various internal components of a fluid mixture dispensing device, such as device 100, that can be housed by casing 102. View 200 is a front-left view of the device and view 250 is a back-right view of the device. These internal components can include solvent reservoir(s) (e.g., water reservoir(s) and/or alcohol reservoir(s)) such as solvent reservoirs 108*a* and 108*b*, ingredient reservoirs such as ingredient reservoirs 106, a cartridge for the ingredient reservoirs, such as cartridge 105, mixing channels, mixing chambers, heat exchangers (e.g., heaters/chillers), and/or dissolution chamber(s) as well as various fluid moving mechanisms (e.g., valves, actuators, pumps, etc.).

The internal components of the device 100 can also include a set of valves, such as valve 120, connected to the ingredient reservoirs 106. A set of ingredient reservoirs 106 have been removed over the exposed valves 120 in the left portion of FIG. 2. Those valves can be configured to fluidly connect the ingredient reservoirs 106 in cartridge 105 to the mixing area of the device 100, where one or more ingredients from ingredient reservoirs 106 and/or one or more solvents from solvent reservoirs 108*a* and 108*b* can be mixed to form an intermediate mixture. The intermediate mixture can then flow to a mixing chamber of the device where the final fluid mixture can be further mixed and dispensed out of the device.

In specific embodiments of the invention, the valves (e.g., valve 120) can be electromechanical valves which require power to be operated. Some fluid mixtures can require several ingredients from different ingredient reservoirs to be dispensed to the mixing area. This could result in a simultaneous current draw from all the valves associated to the several ingredients being actioned at the same time to prepare the fluid mixture, which impacts the overall power budget for the system.

In specific embodiments of the invention, the fluid mixture dispensing system can be configured to sequence one or more components of the device to reduce or smooth the overall current draw of the system while the valves are being operated. In specific embodiments of the invention, the valves draw the most power while they are in the process of being opened. Accordingly, in specific embodiments of the inventions, the valves are opened in a sequence so that the valve opening times do not overlap. In this way, a significant peak in power consumption during dispense (resulting from all the valves being energized at the same time) can be avoided. Alternatively, or in combination, in specific embodiments of the invention, some components of the system can be turned to an off or idle state while the valves are being operated, such as when the valves are being opened. In this way, components of the system that are not required to function continuously can be turned off at dispense time to smooth power consumption. These and other mechanisms to reduce the overall current draw of the system will be disclosed in more detail in this disclosure.

In specific embodiments of the invention, a fluid mixture dispensing device is provided. The device comprises a mixing area, a set of ingredient reservoirs, and a set of electromechanical valves. The set of electromechanical valves: (i) are in a one-to-one correspondence with the set of ingredient reservoirs, and (ii) fluidly connect the set of ingredient reservoirs and the mixing area during a respective set of dispense times. The device comprises a controller programmed to actuate at least two valves from the set of electromechanical valves to dispense, to the mixing area, at least two ingredients from the set of ingredient reservoirs associated with the at least two valves. The controller is programmed to actuate the at least two valves in sequence with partially overlapping dispense times and without overlapping opening times.

In specific embodiments of the invention, a method for a fluid mixture dispensing device is disclosed. The method comprises actuating, by a controller of the fluid mixture dispensing device, at least two valves from a set of electromechanical valves. The method further comprises dispensing, by the at least two valves and in response to the actuating, at least two ingredients from a set of ingredient reservoirs associated with the at least two valves to a mixing area. The set of electromechanical valves: (i) are in a one-to-one correspondence with the set of ingredient reservoirs, and (ii) fluidly connect the set of ingredient reservoirs and the mixing area during a respective set of dispense times. The controller actuates the at least two valves in sequence with partially overlapping dispense times and without overlapping opening times.

In specific embodiments of the invention, a fluid mixture dispensing device is provided. The device comprises a mixing area, a set of ingredient reservoirs, and a set of electromechanical valves. The set of electromechanical valves fluidly connect the set of ingredient reservoirs and the mixing area during a respective set of dispense times. The fluid mixture dispensing device is configured to actuate at least two valves from the set of electromechanical valves to dispense, to the mixing area, at least two ingredients from the set of ingredient reservoirs associated with the at least two valves. The at least two valves are timed to be actuated in sequence with partially overlapping dispense times and without overlapping opening times.

BRIEF DESCRIPTION OF THE DRAWINGS

In the Figures, like reference numbers correspond to like components unless otherwise stated.

DETAILED DESCRIPTION

Reference will now be made in detail to implementations and embodiments of various aspects and variations of systems and methods described herein. Although several exemplary variations of the systems and methods are described herein, other variations of the systems and methods may include aspects of the systems and methods described herein combined in any suitable manner having combinations of all or some of the aspects described.

Figure 1:
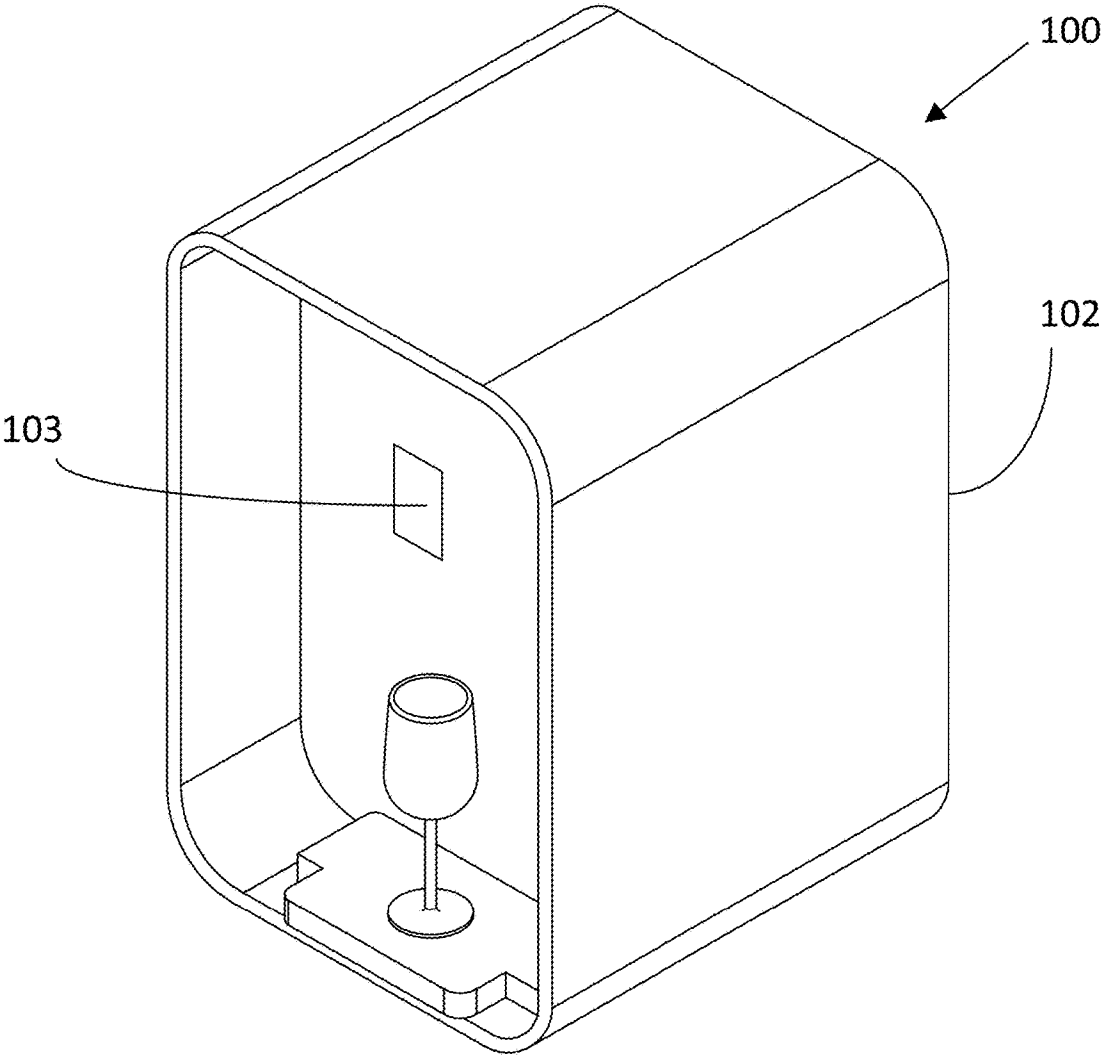
FIG. 1 illustrates an example of a fluid mixture dispensing system, in accordance with specific embodiments of the invention disclosed herein.

Different components and methods for a fluid mixture dispensing system such as device 100 illustrated in FIG. 1 and FIG. 2 will be described in detail in this disclosure. The methods and systems disclosed in this section are nonlimiting embodiments of the invention, are provided for explanatory purposes only, and should not be used to constrict the full scope of the invention. It is to be understood that the disclosed embodiments may or may not overlap with each other. Thus, part of one embodiment, or specific embodiments thereof, may or may not fall within the ambit of another, or specific embodiments thereof, and vice versa. Different embodiments from different aspects may be combined or practiced separately. Many different combinations and sub-combinations of the representative embodiments shown within the broad framework of this invention, that may be apparent to those skilled in the art but not explicitly shown or described, should not be construed as precluded.

As illustrated with reference to FIG. 2, the fluid mixture dispensing device 100 can include one or more ingredient reservoirs, such as ingredient reservoir 106. The ingredient reservoirs can be any of the ingredient reservoirs described in U.S. Provisional Patent Application No. 63/146,461 filed Feb. 5, 2021, U.S. patent application Ser. No. 17/547,081 filed Dec. 9, 2021, and U.S. patent application Ser. No. 17/545,699 filed Dec. 8, 2021, all of which are incorporated by reference herein in their entirety for all purposes.

An ingredient reservoir can include an "ingredient" also referred to herein as an "ingredient mixture." An ingredient mixture can include at least one primary/functional ingredient. A primary/functional ingredient can be at least one of a solid, liquid, or a gas. An example of a primary/functional ingredient can be chemical compounds.

In some embodiments, the ingredient mixture can include various concentrations of chemical compounds. In some embodiments, an ingredient mixture can include at least one solvent. The at least one solvent can be any combination of solvents disclosed herein. For example, an ingredient mixture in an ingredient reservoir can be a mixture of citric acid (primary/functional ingredient) and water at a particular concentration. Another ingredient mixture can be a mixture of potassium sulfate (primary/functional ingredient), water, and ethanol. As discussed herein, these ingredients/ingredient mixtures can get dispensed into a fluid stream (which could be a mixture in itself of solvent (e.g., water and/or ethanol)) and combined together to form an intermediate fluid mixture. In some embodiments, an ingredient mixture can also include at least one of a solvent (e.g., water and/or an alcohol) and an additive ingredient. An additive ingredient can be at least one of a surfactant, preservative, or an emulsifier/stabilizer.

Ingredient or ingredient mixtures can be stored in ingredient reservoirs, such as ingredient reservoir 106. In some embodiments, the ingredient reservoirs can include bladder bags, syringes, gravity dispense chambers, pellet dispenser, and/or pierceable volumes. In some embodiments, the ingredient reservoirs can be the same, vary, or a combination thereof in the system. In some embodiments, the fluid mixture dispensing system can include a plurality of ingredient reservoirs.

In some embodiments, in response to receiving a request for a fluid mixture, the system can flow a predetermined amount of at least one ingredient from a plurality of ingredient reservoirs to at least one mixing channel to form an intermediate fluid mixture. The device can include multiple mixing channels. The term mixing area will be used in this disclosure to refer to any area in which an intermediate fluid mixture is mixed including, for example one or more mixing channels in which one or more ingredients are mixed with one or more solvents. The predetermined amount of the at least one ingredient can be mixed with at least one solvent (e.g., water from a water reservoir and/or alcohol from an alcohol reservoir) in the at least one mixing channel before flowing to a mixing chamber. The at least one solvent can dissolve the at least one ingredient and/or carry the at least one ingredient to the mixing chamber.

In some embodiments, in response to receiving a request for a fluid mixture, the system can flow a predetermined amount of at least one ingredient from at least one ingredient reservoir to other parts of the system, such as the mixing chamber, or to at least one dissolution chamber to form an intermediate mixture. In some embodiments, the at least one ingredient reservoir that is configured to flow an ingredient directly to the mixing chamber and/or dissolution chambers may not be one of the ingredient reservoirs that is fluidly connected to the at least one mixing channel.

In some embodiments, the predetermined amounts of the ingredient(s) can be specific to the requested fluid mixture. In other words, the predetermined amounts of the ingredient (s) that is flowed to the mixing chamber whether it be flowed directly there or in an intermediate mixture or mixtures from a mixing area can correspond to the amount of the ingredient (s) in a predefined fluid mixture, for example a fluid mixture selected from a library of predefined fluid mixtures.

In some embodiments, a predetermined amount of an ingredient from an ingredient reservoir can be dispensed via at least one microfluidic pump into a mixing area including at least one mixing channel, or into the mixing chamber, and/or at least one dissolution chamber. In some embodiments, every ingredient reservoir can be fluidly connected to a microfluidic pump for dispensing an ingredient in an ingredient reservoir to a mixing channel, the mixing chamber, and/or at least one dissolution chamber. In some embodiments, multiple ingredient reservoirs can be fluidly connected to a microfluidic pump for dispensing ingredients from the ingredient reservoirs.

The ingredient reservoirs can be provided in one or more cartridges, such as cartridge 105 illustrated with reference to FIG. 2. The cartridge can include a pressurized chamber to keep the ingredient reservoirs under pressure and facilitate dispense of such ingredients. The cartridge can be any of the cartridge described in U.S. Provisional Patent Application No. 63/146,461 filed Feb. 5, 2021, U.S. patent application Ser. No. 17/547,081 filed Dec. 9, 2021, U.S. patent application Ser. No. 17/547,612 filed Dec. 10, 2021, and U.S. patent application Ser. No. 17/545,699 filed Dec. 8, 2021, all of which are incorporated by reference herein in their entirety for all purposes.

Figure 2:
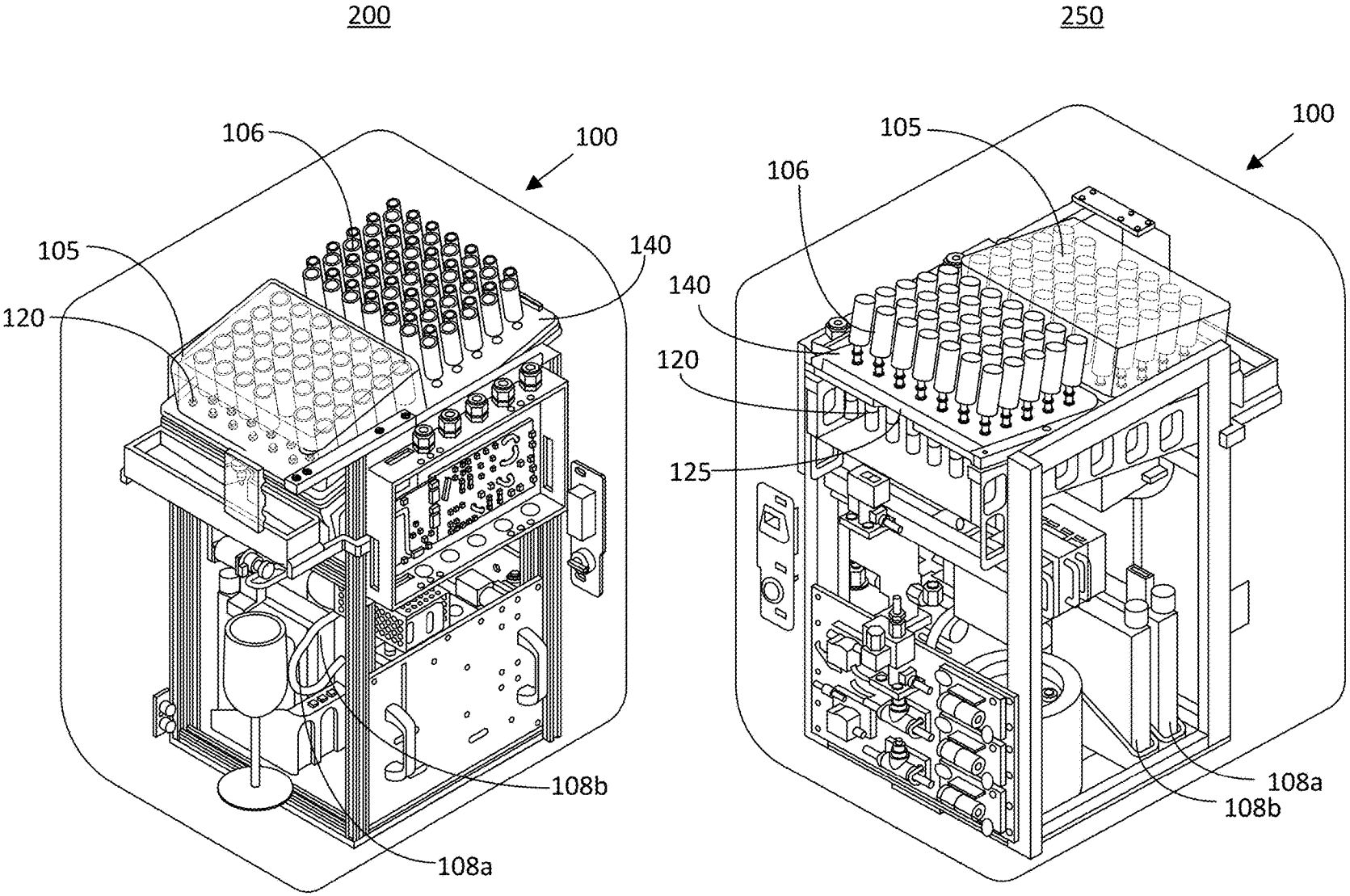
FIG. 2 illustrates examples of various internal components of a fluid mixture dispensing device such as the fluid mixture dispensing system in FIG. 1, in accordance with some embodiments disclosed herein.

FIG. 2 shows the set of ingredient reservoirs, such as ingredient reservoirs 106, packaged in the ingredient cartridge 105. In some embodiments, the system can include one or more ingredient cartridges. For example, at least one of 0-N solid ingredient cartridges, 0-N gaseous ingredient cartridges, 0-N multi-ingredient cartridges, and 0-N liquid ingredient cartridges. In some embodiments, an ingredient cartridge 105 can include a plurality of ingredient reservoirs 106.

In some embodiments, at least one cartridge can be configured to dispense a predetermined amount of the at least one ingredient from at least one ingredient reservoir to a mixing area (including one or more mixing channels), the mixing chamber, and/or at least one dissolution chamber. In some embodiments, the at least one cartridge can be removably attached from the fluid mixture dispensing system so that it can be replaced, serviced (ingredients refilled/replaced) and recyclable. In some embodiments, the fluid mixture dispensing system can still operate with a cartridge missing or empty.

In some embodiments, a predetermined amount of at least one ingredient can be dispensed via at least one valve, such as valve 120, into the mixing area, the mixing chamber, and/or at least one dissolution chamber. The valves, such as valve 120, can be electromechanical valves, and include an actuator. The actuators can be solenoids and the valves can generally be called solenoid valves. In some embodiments, each ingredient reservoir can have an individual valve with an individual associated actuator. In some other embodiments, more than one ingredient reservoir can be associated to the same valve and/or actuator. In some embodiments, each valve can be configured to control the flow of an ingredient from an ingredient reservoir to the mixing area, the mixing chamber, and/or at least one dissolution chamber.

In some embodiments, the at least one cartridge, such as cartridge 105, can include a pressurized chamber inside the cartridge. In specific embodiments, the pressurized chamber can be formed by the cartridge itself. This pressurized chamber can house the plurality of ingredient reservoirs, such as ingredient reservoir 106, such that a pressure can be applied to the ingredient reservoirs. In some embodiments, the system (e.g., a controller, a pressure regulator, or other elements as will be described below in more detail) can be configured to control the pressure of the pressurized chamber. Accordingly, the cartridge can be pressurized such that when the valve of an ingredient reservoir is opened (e.g., valve 120 for ingredient reservoir 106), the ingredient stored in that ingredient reservoir can flow out of the ingredient reservoir towards a mixing channel, the mixing chamber, and/or at least one dissolution chamber. The ingredient reservoirs can be loaded into or attached to the pressurized chamber with a controlled pressure for providing an expulsion force.

The mixing area (including one or more mixing channels), the mixing chamber, and/or at least one dissolution chamber can be fluidly connected to the valve outputs of the ingredient reservoirs such that any valve opening can result in an ingredient flowing to a mixing area (including one or more mixing channels), the mixing chamber, and/or at least one dissolution chamber. In some embodiments, the controller can be configured to open at least one valve for a time based on at least the pressure of the pressurized chamber, the physical flow characteristics of the specific ingredient in the ingredient reservoir, and/or the diameter of the at least one valve opening to control the flow of the predetermined amount of the at least one ingredient to be dispensed. Accordingly, for a specific ingredient in an ingredient reservoir, the system can be calibrated to dispense/flow a predetermined amount of the specific ingredient to a mixing area (including one or more mixing channels), the mixing chamber, and/or at least one dissolution chamber based on the pressure of the pressurized chamber, the physical flow characteristics (e.g., viscosity) of the specific ingredient in the ingredient reservoir, and/or the diameter of the valve opening (or diameter of orifice as explained below). As such, the time interval that the at least one valve is open can proportionally correspond to amounts/concentrations of at least one ingredient of a list of ingredients of a predefined fluid mixture (from a chemical analysis). Dispensing an expected amount of an ingredient, as controlled by the time the valve is open, using the approaches disclosed in this paragraph is referred to in this disclosure as a time-based ingredient dispensing method.

In some embodiments, the ingredients stored in the ingredient reservoirs (e.g., 106) can be ported to the valves (e.g., 120) beneath the ingredient reservoir. In some embodiments, the ingredient reservoirs (and their valves) can open to a mixing area. In some embodiments, a plurality of ingredient reservoirs can be fluidly connected to the mixing area including a single mixing channel. In some embodiments, a mixing channel can be fluidly connected to a plurality of mixing channels and a second mixing channel can be fluidly connected to a second plurality of mixing channels. For example, a first mixing channel may have 5-20 ingredient reservoirs fluidly connected to it and a second mixing channel may have 5-20 of the same or different ingredient reservoirs fluidly connected to the second mixing channel. In those embodiments, the mixing area can include the plurality of mixing channels. Accordingly, at least one solvent (e.g., water and/or ethanol) can flow through the mixing area and collect any ingredient dispensed into the mixing channels. In some embodiments, at least one solvent can also be dispensed into the mixing area in order to remove any leftover ingredients.

In some embodiments, the mixing channel(s) can be formed into the bottom of a plate, such as plate 140 illustrated in FIG. 2. All the mixing channels can be fluidly connected to the solvent reservoir(s) and the mixing chamber. As such, solvent can enter at least one mixing channel and at least one ingredient from at least one mixing reservoir can flow into the mixing channel to form an intermediate mixture with the solvent.

In specific embodiments of the invention, the solvents used can be water, alcohol, ethyl lactate, and/or propylene glycol. At least one solvent reservoir can supply at least one solvent to the fluid mixture to be dispensed. For example, at least one solvent reservoir 108*a* is shown in FIG. 2 and can be, for example, a water reservoir. In some embodiments, the fluid mixture dispensing system can include a plurality of solvent reservoirs (e.g., one or multiple water reservoirs, one or multiple alcohol reservoirs, one or multiple propylene glycol reservoirs, one or multiple ethyl lactate reservoirs, and/or mix of alcohol and water reservoirs, among other variations). In some embodiments, any water reservoir(s) can include a water filter such that the water filter can remove impurities from the water in the water reservoir(s) prior to flowing the water to the other parts of the system (e.g., mixing chamber).

The at least one solvent reservoir can supply solvent to the fluid mixture to be dispensed. For example, any water reservoir can supply water to the fluid mixture to be dispensed. In some embodiments, a solvent reservoir is a solvent container housed within the fluid mixture dispensing system to supply solvent(s) to the system. The solvent(s) can be used to dissolve or carry various other ingredients to form the requested fluid mixture. In some embodiments, in response to receiving the request for a fluid mixture, the system (e.g., a controller of the system) can flow a predetermined amount of at least one solvent from at least one solvent reservoir to at least one mixing channel to form an intermediate fluid mixture.

In some embodiments, a water reservoir is a water container housed within the fluid mixture dispensing system. In other embodiments, the water reservoir may be a standard water outlet such as a faucet or water line that can be connected to the fluid mixture dispensing system to supply water to the system. In addition, water can be used as a solvent to dissolve various other ingredients to form the requested fluid mixture. In some embodiments, in response to receiving the request for a fluid mixture, the system (e.g., a controller of the system) can flow a predetermined amount of water from a water reservoir to at least one mixing channel to form an intermediate fluid mixture. The predetermined amount of water can be mixed with alcohol from an alcohol reservoir and/or ingredients (i.e., ingredient mixtures) from a plurality of ingredient reservoirs in the at least one mixing channel to form an intermediate mixture before flowing to the mixing chamber. In specific embodiments of the invention, the system can flow a predetermined amount of at least one solvent from at least one solvent reservoir to other parts of the system such as the mixing chamber. As such, the mixing chamber can be fluidly connected to a water reservoir.

The predetermined amount of the at least one solvent can be specific to the requested fluid mixture. In other words, the predetermined amounts of solvent(s) that is flowed to the mixing chamber whether it/they be directly flowed there or in an intermediate mixture or intermediate mixtures can correspond to the amount of solvent(s) in the predefined fluid mixture selected from the library of a predefined fluid mixtures. In some embodiments, the predetermined amounts of the at least one solvent can be flowed from the at least one solvent reservoir throughout the system via at least one pump.

In some embodiments, the fluid mixture dispensing system can include more than one solvent reservoir, for example a second solvent reservoir such as second solvent reservoir 108*b* illustrated in FIG. 2. The second solvent reservoir can be for the same or different solvent as the first solvent reservoir. In specific embodiments of the invention, the second solvent reservoir, such as 108*b*, can be an alcohol reservoir as illustrated in FIG. 2. In some embodiments, the fluid mixture dispensing system can include a plurality of alcohol reservoirs. The alcohol reservoir can supply alcohol to the fluid mixture to be dispensed. As stated above, the solvent reservoirs can include alcohol (e.g., ethanol), water, ethyl lactate, propylene glycol, and/or a wide variety of other alcohols and/or solvents and their various combinations. Alcohol in the alcohol reservoir can be an alcohol mixture. In some embodiments, the alcohol mixture can include the alcohol and water. For example, an alcohol can be an alcohol mixture of 10-100% alcohol by volume (0-90% water by volume).

In some embodiments, an alcohol reservoir(s) is an alcohol container(s) housed within the fluid mixture dispensing system. Besides supplying the alcohol to a fluid mixture, alcohol can also be used to dissolve various other ingredients to form an intermediate fluid mixture as part of the requested fluid mixture. Alcohol can also be used as a sanitizing agent for the system.

In some embodiments, in response to receiving the request for a fluid mixture, the system (e.g., a controller of the system) can flow a predetermined amount of alcohol from an alcohol reservoir to at least one mixing channel to form an intermediate fluid mixture. The predetermined amount of alcohol can be mixed with water from a water reservoir and/or ingredients from a plurality of ingredient reservoirs in the at least one mixing channel to form an intermediate mixture before flowing to the mixing chamber. In some embodiments, the water and alcohol can be mixed prior to entering the at least one mixing channel.

In some embodiments, in response to receiving a request for a fluid mixture, the system can flow a predetermined amount of alcohol from an alcohol reservoir to other parts of the system such as the mixing chamber and/or a dissolution chamber. As such, the mixing chamber can be fluidly connected to an alcohol reservoir and the alcohol reservoir can be fluidly connected to the at least one dissolution chamber which in turn can be fluidly connected to the mixing chamber.

The predetermined amounts of alcohol can be specific to the requested fluid mixture. In other words, the predetermined amounts of alcohol that is flowed to the mixing chamber whether it be directly flowed there or in an intermediate mixture or mixtures can correspond to the amount of alcohol in the predefined fluid mixture selected from the library of predefined fluid mixtures. For example, if a glass of Chardonnay is selected and the predefined formula for Chardonnay has 14% alcohol by volume, the system would flow predetermined amounts of ethanol to the mixing chamber to be incorporated such that the Chardonnay has 14% alcohol by volume in the final dispensed fluid mixture based on the volume of the other ingredients. In some embodiments, the predetermined amounts of alcohol can be flowed from an alcohol reservoir throughout the system via at least one pump. In some embodiments, the system (e.g., the controller) can be configured to monitor an amount of alcohol or other solvent and/or ingredients in an alcohol, solvent and/or ingredient reservoir.

Figure 3:
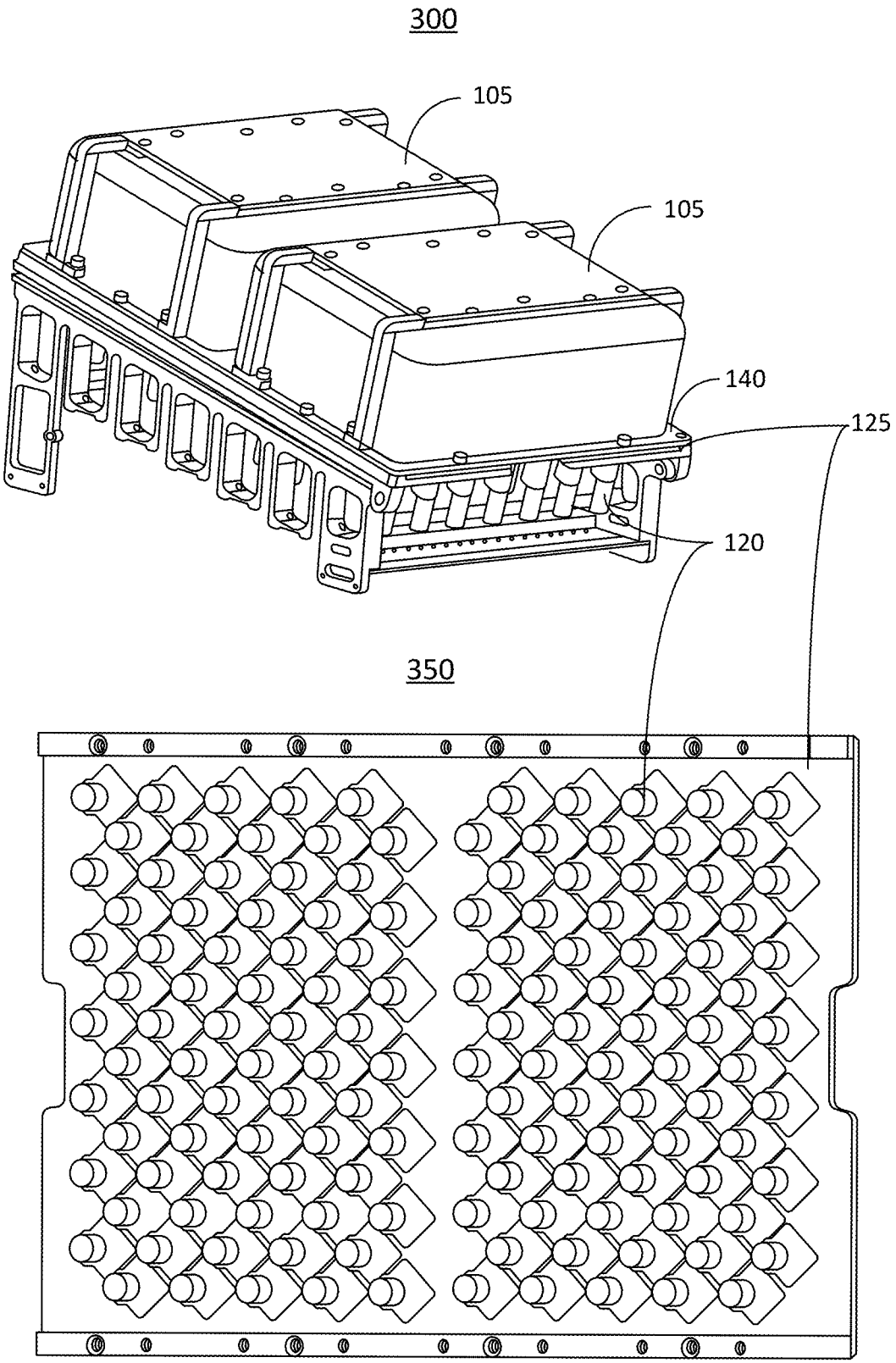
FIG. 3 illustrates a magnified view of part of an exemplary interface of an ingredient cartridges for the fluid mixture dispensing system, in accordance with some embodiments disclosed herein.

As explained before in this disclosure with reference to FIG. 2, ingredients from the ingredient reservoirs (e.g., 106) can be dispensed into the mixing area of device 100 via a set of valves (e.g., valve 120). FIG. 3 includes a magnified view 300 of part of an exemplary interface of the ingredient cartridges 105 with the device 100, which includes the valves 120 and plate 140 (in which the mixing area/mixing channels can be formed, according to specific embodiment of the invention). FIG. 3 also includes an exemplary view 350 of valves (e.g., valve 120) on the underside of a base plate 125 that can control ingredient dispensing into mixing channels of a fluid mixture dispensing system. In specific embodiments of the invention, the valves, such as valve 120, can be electromechanical valves. For example, the valves can be solenoid valves. The part of the valves visible in FIG. 3 can be solenoids that action an upper portion of the valves though the mixing area that can be formed on plate 140.

Figure 4:
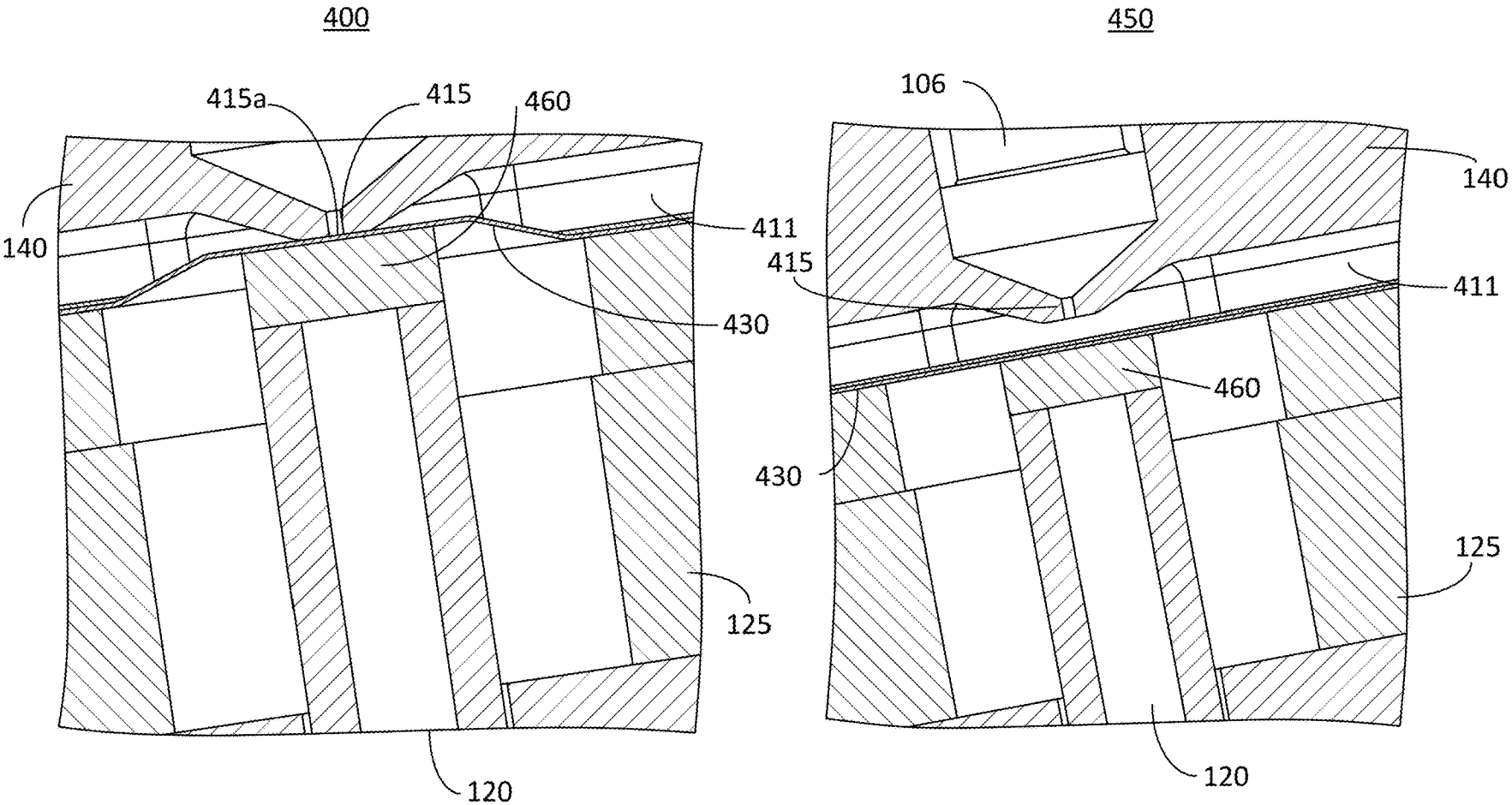
FIG. 4 illustrates a magnified view of an ingredient reservoir in a closed position and a view of an ingredient reservoir in an open position with respect to a mixing area, in accordance with some embodiments disclosed herein.

An example of the operation of the valves, such as valve 120, in accordance with the description above can be given with reference to FIG. 4. FIG. 4 includes a magnified view 400 of an ingredient reservoir in a closed position with respect to a mixing area including mixing channel 411, in accordance with some embodiments disclosed herein. View 450 illustrates a magnified view of an ingredient reservoir in an open position with respect to the mixing area including mixing channel 411, in accordance with some embodiments disclosed herein.

As described before in this disclosure, in some embodiments, the mixing area can include channels formed into the bottom of plate 140. In the example of FIG. 4, a mixing channel 411 is represented. The mixing channels can be fluidly connected to the solvent reservoir(s) and the mixing chamber. As such, solvent can enter at least one mixing channel (e.g., 411) and at least one ingredient from at least one ingredient reservoir (e.g., 106) can flow into the mixing channel to form an intermediate mixture with the solvent.

In specific embodiments of the invention and as illustrated in FIG. 4, each ingredient reservoir can open to an orifice 415. An actuator of the valve 120 can be positioned in a "closed" state or position as illustrated in view 400, in which no ingredient can flow from the ingredient reservoir 106 to the mixing channel 411. The actuator of the valve 120 can alternatively be positioned in an "open" state or position as illustrated in view 450 in which ingredient can flow from the ingredient reservoir 106 to the mixing channel 411.

In some embodiments, the ingredient reservoir (e.g., 106) can connect to a membrane 430 with a flat plate orifice as its output. When a membrane 430 is forced against the orifice 415, no ingredient may flow out of the ingredient reservoir 106. For example, a compliant material 460 such as a rubber pad (e.g., a fluoroelastomer pad) can be pushed up against the membrane 430 such that the membrane closes an opening face 415*a*. The compliant material can be a material with a low set capability such that it can give a consistent even seal over time. The purpose of the compliant material can be to allow for misalignment of the actuator of valve 120 and still allow for a good seal of the valve seat/orifice. In other words, the compliant material can be such that it can be amenable to closing the orifice when it is pushed up against the membrane and valve. However, even when an ingredient reservoir 106 is in the closed position, any fluid/solvent such as water and/or alcohol can still flow through the mixing channel and around the closed ingredient reservoir orifice. When there is no force pushing the membrane 430 against the orifice opening, the ingredient can flow through the orifice to the mixing channel.

Orifice diameters can range from about 0.01-5 mm or about 0.05-1 mm depending on the physical flow characteristics of the ingredient stored in the particular ingredient reservoir. In specific embodiments of the invention, the diameter of the orifice can determine the flow rate through it for a given ingredient physical flow characteristic and cartridge/chamber pressure. In some embodiments, the valve and ingredient reservoir assembly can be interfaced with solenoids or other actuator below that are connected to a base plate 125, whose plungers can be pre-loaded against the membrane valves by springs or other force. In some embodiments, the plungers can be pre-loaded approximately at least or equal to about 1 N against the membrane valves by their springs. In some embodiments, the solenoid actuators' plungers can be biased with springs away from the solenoid coils such that they push with a controlled preload of force against the membrane valves.

In specific embodiments of the invention, switching a valve from a closed state (such as in view 400) to an open state (such as in view 450) requires energizing the valve. In other words, power may be needed to operate the actuators of valve 120 so that an ingredient from ingredient reservoir 106 can be dispensed to the mixing area, for example to mixing channel 411. In specific embodiments of the invention the current consumed by each valve can be significant when compared to the overall power budget of the system.

The overall power budget of the system can be based on various factors. In specific embodiments of the invention, the power budget can accommodate the worst-case power draw of the system. The power budget of the system can be based on the power required to operate the valves for ingredient dispense along with other components of the system that remain working at the dispense time. In specific embodiment of the invention, the system can include a cooler element, for example to prepare chilled beverages. The cooler element can be thermoelectric cooler (TEC)/Peltier element. In those embodiments, the worst-case power draw of the system can be the "chilling" state. Using this example as a reference, but not as a limitation of the invention, the worst-case can occur while the TEC element is in an on state. In specific embodiments of the invention, the TEC/Peltier element consumption can be given by approximately: 12V*16 A=192 W. Assuming that some other electromechanical components are on, for example at least one pump and at least 3 valves, an additional consumption can be given by approximately: 12V*2 A=24 W. Assuming, also, that there are sub-systems of the system that remain working at all times, or at least during the dispense time, such as for example a User Interface and/or any standby system, an additional consumption can be given by approximately: 12V*1 A=12 W. A margin of power consumption to compensate for any possible variations in the above consumption estimates can be also included in this calculation. As an example, a margin of 24 W will be used. In this example, the total load for the system would be of 252 W. This could be an example of the determination of the power budget of the system. In specific embodiments of the invention, a nominal supply of 300 W is used, with a power supply efficiency of 85%. In specific embodiments of the invention, the worst-case example above could represent a total line draw of approximately 297 W.

Although the worst-case example given above involved a cooling element, this is not a limitation of the invention. Other elements can be prioritized while the valves are energized. If the cooling element was not in progress in the example above, there could be a large overhead to actuate the valves if the same power budget is considered. However, in specific embodiments of the invention, a practical goal is to keep peak and average power consumption of the ingredients valve system as consistent as possible to optimize cost of the power supply and other resources, while simultaneously optimizing dispense time. Therefore, regardless of what other element, if any, is prioritized together with the ingredients dispense mechanisms, the invention can offer significant advantages from the power consumption perspective of the system.

A fluid mixture to be prepared using the fluid mixture dispensing device 100 can include any number of ingredients. For example, about 15 ingredients from different ingredient reservoirs 106 may be needed for a given mixture. In this example, if each ingredient reservoir is individually connected (i.e., in a one-to-one correspondence) to a valve, 15 different valves would need to be open for the ingredients to be dispensed to the mixing area, which can considerably increase the current drawn by the system during the time the ingredients are being dispensed from the ingredient reservoirs.

Specific embodiments of the invention utilize a mechanism to reduce the overall current draw of the system 100, for example during the dispense time of two or more valves. The mechanism can include sequencing the valves so that they have different opening times. In other words, the valves can be opened in a sequence without overlapping opening times. This mechanism can involve opening one valve at a time, and therefore can result in smoothing a spike in power consumption produced by multiple valves opening at the same time. "Opening time", as used in this disclosure, refers to the time at which a valve changes from a closed state (such as in view 400, preventing an ingredient to be dispensed from an ingredient reservoir 106 into the mixing area), to an open state (such as in view 450, allowing the ingredient from the ingredient reservoirs 106 to be dispensed into the mixing area).

In specific embodiments of the invention, different valves can have different dispense times. "Dispense time", as used in this disclosure, refers to the period of time that a valve stays in an open state (such as in view 450), allowing the ingredient from the ingredient reservoir 106 to be dispensed into the mixing area. The dispense time can be the time determined for the time-based ingredient dispensing method described before in this disclosure. The dispense time can vary depending on numerous factors. For example, the dispense time can vary depending on the amount of ingredient to be dispensed from the ingredient reservoir, in that a larger amount of ingredient may require a longer dispense time. The dispense time can also vary depending on the characteristics of the ingredient to be dispensed. For example, a more dense or viscous ingredient may require a longer dispense time than the same amount of a less dense ingredient. The dispense time can also vary depending on the diameter of the ingredient reservoir's orifices 415, in that a larger amount of ingredient can be dispensed through a larger orifice and therefore require a shorter dispense time. These and other factors can impact the dispense time of certain valves, such as valves 120.

Figure 5:
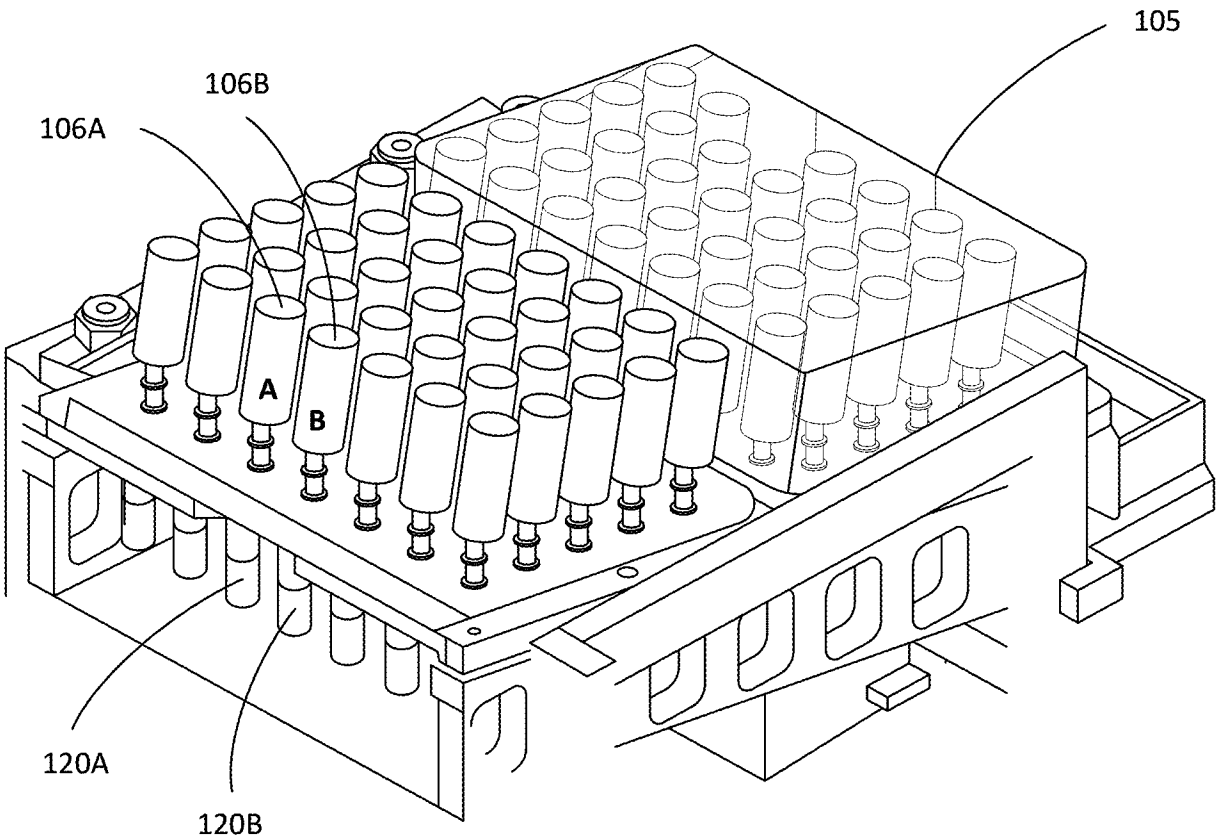
FIG. 5 illustrates an example of two ingredient reservoirs in a set of ingredient reservoirs, each housing a respective ingredient, and actioned by respective valves to dispense ingredients for a fluid mixture which requires ingredients A and B, in accordance with some embodiments disclosed herein.

FIG. 5 illustrates an example of two ingredient reservoirs in a set of ingredient reservoirs, 106A and 106B, each housing a respective ingredient A and B, and actioned by respective valves 120A and 120B to dispense ingredients for a fluid mixture which requires ingredients A and B. The example of a fluid mixture requiring two different ingredients is for explicative purposes only. Any number of ingredients may be required by a given fluid mixture, which can involve more than two ingredient reservoirs and more than two valves. Specific embodiments of the invention are more advantageous for situations in which there is a larger number of ingredients and corresponding valves involved, because the current draw in those situations is higher.

In the example of FIG. 5, the two valves 120A and 120B could be opened simultaneously, (i.e., with overlapping opening times) to dispense ingredients A and B. This would cause the two valves to be energized at the same time and therefore consume power from the system simultaneously. Alternatively, and in accordance with specific embodiments of the invention, the valves can be opened without overlapping opening times. For example, valve 120A can be opened first (at a first opening time) to dispense ingredient A from ingredient reservoir 106A; and valve 120B can be opened second (at a second opening time) to dispense ingredient B from ingredient reservoir 106B. This mechanism would require the valves to be energized at different times (i.e., the first and second opening times), and prevent a power consumption peak that would otherwise happen if the valves were simultaneously energized.

The time interval between opening times of two subsequent valves can be set by a device manufacturer. For example, the time interval could be programmed into the firmware of the device based on a measurement taken of the expected opening times for the valves used in a given device. In specific embodiments of the invention, the time interval between opening two subsequent valves can depend on the time that the valves take to switch from a closed state to an open state. This time can vary depending on the type of valve being used. In specific embodiments of the invention, the valves take at least 25 milliseconds to open (i.e., switch from a closed state as in view 400 in FIG. 4 to an open state as in view 450 in FIG. 4). In alternative embodiments of the invention, the valves take at least 10 milliseconds to open. In these embodiments, the opening times of two subsequent valves (for example the first opening time for valve 120A and the second opening time for valve 120B in the example of FIG. 5) can be spaced by at least 25 milliseconds or by at least 10 milliseconds. In this way, the second opening time would be at least 25 milliseconds or at least 10 milliseconds later that the first opening time.

In specific embodiments of the time to open the valves (e.g., the 25 milliseconds of the example above) can be the time that it takes for the valves to completely change from one state to the other. However, dispense can occur during such time when the valves are in the process of switching states. This dispense can be minimal and at a different flow rate than what would be dispensed when the valves are fully open because of the different geometry of the dispense path as the actuator of the valve is moved. In this way, in specific embodiments of the invention, dispense times shorter than the striking time of the valves (e.g., 25 milliseconds) are technically possible, but the accuracy of that dispense can be compromised, due to non-linear effects of the valve opening. In specific embodiments of the invention, the minimum volume of ingredient needed for a fluid mixture can be larger than what can be dispensed in 25 milliseconds. In this way, the controller can have more precise control of the dispensed volumes (for example, decide when to close a valve once the valve has been fully open and a flow at an expected dispense flow rate has been dispensed). For example, in specific embodiments of the invention a minimum ingredient dispense volume can be approximately 50 uL. Considering an exemplary dispense flow rate of 1 uL/ms, dispensing the minimum volume could take up around 50 milliseconds. However, there can be a non-linear flow below the strike time (e.g., 25 milliseconds). The controller can be aware of this non-linear flow and either consider it in volume dispensed determinations or not (depending on how negligible is this non-linear dispense according to system's tolerances).

In specific embodiments of the invention, the valves can be actuated in a sequence so that they do not have overlapping opening times but can or cannot have overlapping dispense times. The valves can require a larger amount of power to be opened (i.e., to switch from a closed state as in view 400 of FIG. 4 to an open state as in view 450 of FIG. 4) than they require to remain in the open state (as in view 450 of FIG. 4). For example, the power draw of an ingredient dispense valve, such as valve 120, can be at maximum during the striking time (while the valves are switching states, for example, during the first 25 milliseconds of operation) due to extra current that may be required to energize the valve (e.g., magnetize the armature and housing of the valve). This can be referred as the "strike" current. When the valve is fully open, current may be reduced as the magnetic circuit is complete. For example, in specific embodiments of the invention current may be reduced by a factor of 2 when the valve is fully open. This can be referred as the "hold" current. In specific embodiments of the invention, the average holding current can be less than the average strike current by a factor of 4. In specific non-limiting embodiments of the invention, the power required for each valve can be 6 W to open (while the strike current is supplied) for 25 milliseconds, and 1.5 W to hold for the rest of the time the valve is open (while the hold current is supplied). In this way, it can be an option to open a subsequent valve while the previous valve is still in an open state, so that two or more valves can have at least partially overlapping dispense times (i.e., be in an open state at the same time even though they do not have overlapping opening times).

In the example of FIG. 5, for example, valve 120A can be opened at a first opening time to dispense ingredient A, and valve 120B can be opened at a second opening time, while valve 120A is still open and dispensing ingredient A into the mixing area, to dispense ingredient B. In this example, valves 120A and 120B are actuated without overlapping opening time, but with partially overlapping dispense time. This can be advantageous in that the overall time for preparing a fluid mixture (e.g., a beverage) can be reduced, compensating for the extra time consumed by not opening the valves at the same time.

The determination as to the opening times for each valve, for example what valve to actuate first and in what order the subsequent valves can be opened, can be made by a controller of the system configured to actuate the valves, and based on various factors. For example, the valves can be opened based on a volume to be dispensed by each valve, so that the valve associated with the ingredient to be dispensed in a larger volume is opened first. In this way, the overall time for preparing a fluid mixture by device 100 can be optimized by opening first the valve for the ingredient which will potentially take more time to be dispensed, and the valves for other ingredients from which a smaller amount may be required can be opened at subsequent opening times and dispense the other ingredients while the first ingredient is still being dispensed. The order in which the various valves are opened can also depend on other factors such as the characteristics of the respective ingredient to be dispensed. For example, the controller can determine characteristics of the ingredient that could impact the overall dispense speed, such as the degree of viscosity of the ingredients, and actuate the valves so that the ingredient with a higher degree of viscosity is open first. In specific embodiments of the invention, the order in which the various valves are opened is randomly established by a controller. For example, if two or more ingredients are to be dispensed in the same volume, the controller can randomly determine which valve to open first so that they are opened without overlapping opening times.

The controller of the system can be configured to obtain the volume of each ingredient to be dispensed based in various ways. For example, the volume of an ingredient to be dispensed for a given fluid mixture can be obtained from a recipe for the fluid mixture that the controller has access to. The recipe can be stored locally in a memory accessible to the controller or remotely such as in a recipe server or the Internet. Alternatively, or in combination, the controller can determine the volume to be dispensed based on data received from a user, for example via the user interface 103 and/or a mobile device operating in association with device 100. The controller can also be configured to determine the characteristics of the ingredients (such as the degree of viscosity mentioned before) based on information for the ingredients that can likewise be stored in a memory accessible to the controller.

The controller can be further programed to determine the dispense time for each valve. As explained before in this disclosure, the dispense time can be associated to the volume of the ingredient to be dispensed and other factors. In this way, the dispense time can be individually customizable for each valve. The dispense time can be individually customized based on the volume to be dispensed, and such volume can be obtained for example from a recipe for the fluid mixture, as explained before with reference to the opening times.

With reference back to the example of FIG. 5, a controller of the system can be configured to cause the system to prepare a fluid mixture "AB" that includes a volume "Vol A" of ingredient A and a volume "Vol B" of ingredient B. The controller can receive the information regarding the values for "Vol A" and "Vol B" from a recipe for the fluid mixture "AB." The controller can receive the information regarding the values for "Vol A" and "Vol B" in the form of instructions to prepare the fluid mixture "AB." The controller can be programmed to associate the respective volumes "Vol A" and "Vol B" of ingredients A and B to respective dispense times "Time A" and "Time B" for valves 120A and 120B respectively. The controller can be programed to determine the opening time of the valves (e.g., which valve to open first) based on the respective dispense times and/or the respective volumes. The controller can then be programmed to actuate the valves to open them at the respective opening times and hold them open for the respective dispense times.

Figure 6:
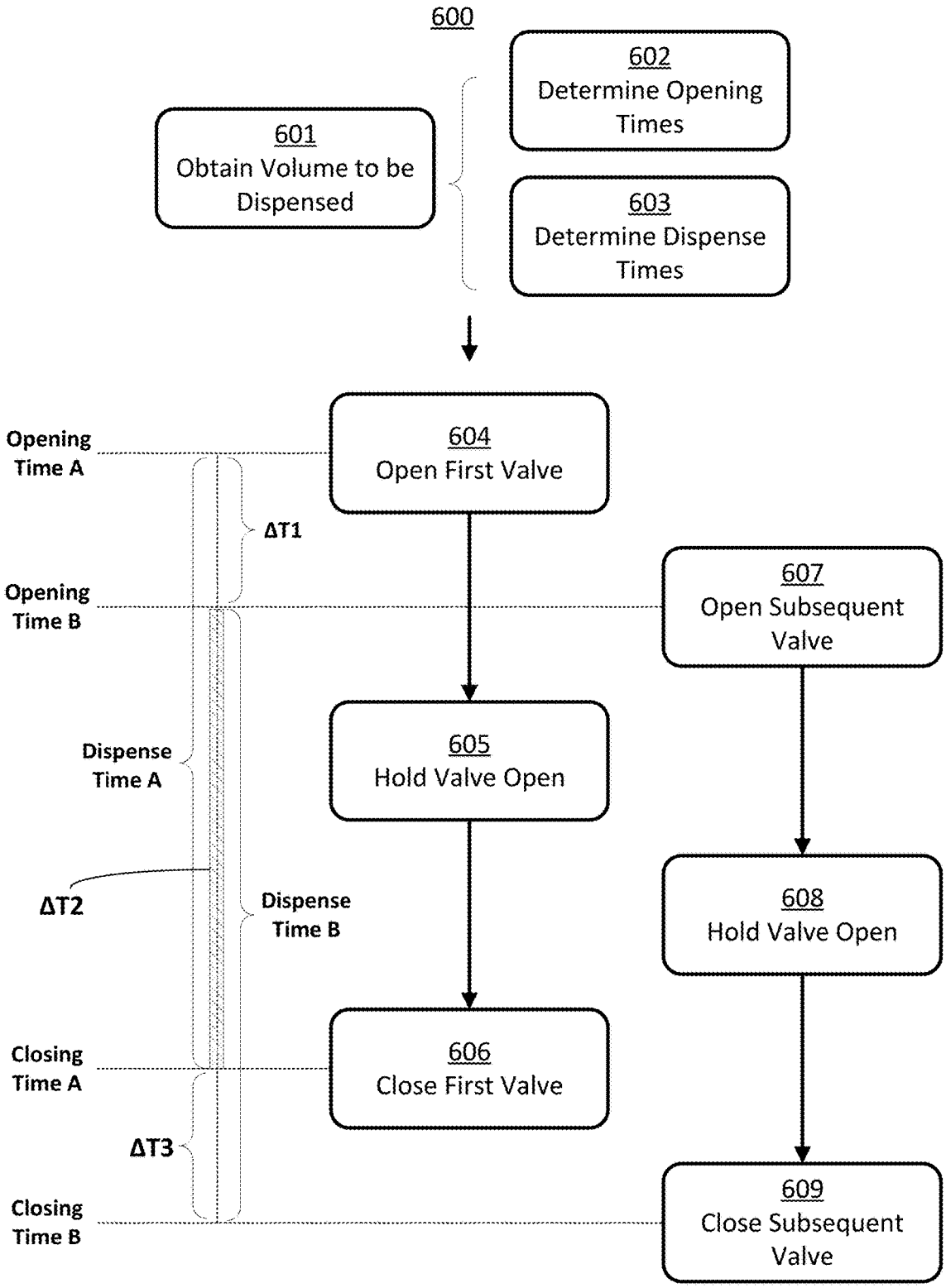
FIG. 6 illustrates a flowchart for a set of methods for a fluid mixture dispensing device, in accordance with some embodiments disclosed herein.

FIG. 6 illustrates a flowchart 600 for a set of methods for a fluid mixture dispensing device, in accordance with specific embodiments of the invention. Flowchart 600 incudes a step 602 of determining the opening times of a set of valves to be actuated to dispense a set of ingredients for a given fluid mixture. Flowchart 600 also includes a step 603 of determining the dispense times for the set of valves. Steps 602 and 603 can be preceded by a step 601 of obtaining a volume to be dispensed by each valve. Step 601 can include receiving the volume to be dispensed from memory or an external system, calculating the volume to be dispensed using available values, or any other action that results in the controller having knowledge of the volume to be dispensed. As explained before in this disclosure, a controller in the system can determine the volume to be dispensed and based on such determination, determine the opening times (e.g., which valve to open first and/or the order for opening subsequent valves) and determine the dispense time (e.g., for how long each valve will be open). The system can also perform steps 602 and 603 without performing step 601. For example, the opening and dispense times can be already stored in a memory accessible to the controller, or be determined based on other factors other than the volume, such as a characteristic of the ingredients, a recipe for the mixed fluid, a user input, etc.

Once the opening times and dispense times have been determined, flowchart 600 can continue with a step 604 of opening a first valve at a first "Opening Time A." As previously explained, the first valve can be, for example, the valve associated with the ingredient to be dispensed in a larger amount. The flowchart 600 continues with a step 605 of holding the first valve open for a "Dispense Time A." The flowchart continues with a step 606 of closing the first valve at a "Closing Time A" after the "Dispense Time A" has passed (i.e., the respective volume of ingredient has been dispensed to the mixing area).

Flowchart 600 includes a step 607 of opening a subsequent valve at an "Opening Time B." As illustrated, step 604 and step 607 are spaced apart by a period of time ΔT1. Therefore, the first valve and the subsequent valve can be opened without overlapping opening times. In specific embodiments of the invention, the value of ΔT1 can be selected so that it is small enough as to reduce the overall time for preparing a fluid mixture by the device, while still providing not overlapping opening times. The value of ΔT1 can be any value determined by a system manufacturer based on the characteristics of the valves that are used, for example 25 milliseconds.

Flowchart 600 also includes a step 608 of holding the subsequent valve open for a "Dispense Time B." The flowchart continues with a step 609 of closing the subsequent valve at a "Closing Time B" after the "Dispense Time B" has passed (i.e., the respective volume of ingredient has been dispensed to the mixing area). As illustrated, the "Dispense Time A" of the first valve and the "Dispense Time B" of the subsequent valve can partially overlap by a period of time ΔT2. This period will depend on the respective dispense time for each valve. In specific embodiments of the invention and as illustrated in the example of FIG. 6, the first valve can be closed while the subsequent valve is still open. However, this is not a limitation of the present invention. For example, the first valve can be open long enough so that the second valve closes while the first valve is still open. This can happen in embodiments in which an ingredient is to be dispensed in a considerably larger amount than other ingredients. In those embodiments, the valve for the ingredient to be dispensed in a larger amount can be opened first, and multiple other valves can be subsequently open, without overlapping opening times, but with partially overlapping dispense time with respect to the first valve or other valves subsequently open. The partially overlapping dispense time ΔT2 can also be zero or even negative in situations in which subsequent valves do not have overlapping dispense times with the previous ones. For example, if "Dispense Time A" was shorter or equal to ΔT1, there would be no overlapping dispense time ΔT2.

In the example of FIG. 6, "Dispense Time B" has been represented so that it extends for a period of time ΔT3 after "Dispense Time A" has ended (i.e., the subsequent valve is still open when the first valve is closed). However, this is not a limitation of the present invention. The period ΔT3 can be zero or even negative in situations in which the dispense time for the subsequent valve is shorter.

Flowchart 600 can be implemented for any number of valves in a system in the same manner as described herein for a first valve and a subsequent valve. Implementing these methods can result in reducing the overall current draw of the system caused by the actuation of the valves during the dispense of ingredients because the valves can be actuated without overlapping opening times. At the same time, these methods can result in reducing the overall time for preparing a fluid mixture while opening the valves without overlapping opening times, because the valves can have partially overlapping dispense times. As explained, the opening and dispense times can be determined so as to optimize the dispense, by for example considering how much of each ingredient will be dispensed to decide such opening and dispense times.

In specific embodiments of the invention, a fixed number, greater than one, of valves in a system can be opened simultaneously (or otherwise have overlapping opening times) so long as that fixed number of valves drew less power than the overall power budget of the system. During the mixing of a complex fluid mixture with a large number of ingredients, the valves could then be open in sets of the fixed number of valves where every valve in the set had overlapping opening times, but valves in different sets did not have overlapping opening times.

In specific embodiments of the invention, the valves can be grouped in subsets. In those embodiments, the controller can be programmed to actuate one valve per subset at a time, so that the subsequent valve to be open is from a different subset of valves than the previous one if the previous one is still open. In this way, valves from the same subset of valves do not necessarily have overlapping dispense times, which can be advantageous for a controlled dispensing.

In specific embodiments of the invention, other mechanisms can be implemented in order to smooth the peak in power draw that can be caused by the dispense of ingredients by the valves. For example, some components of the system can be turned to an off or idle state when the valves are being energized for dispense, so that the power in the system can be reserved mainly for this task.

Figure 7:
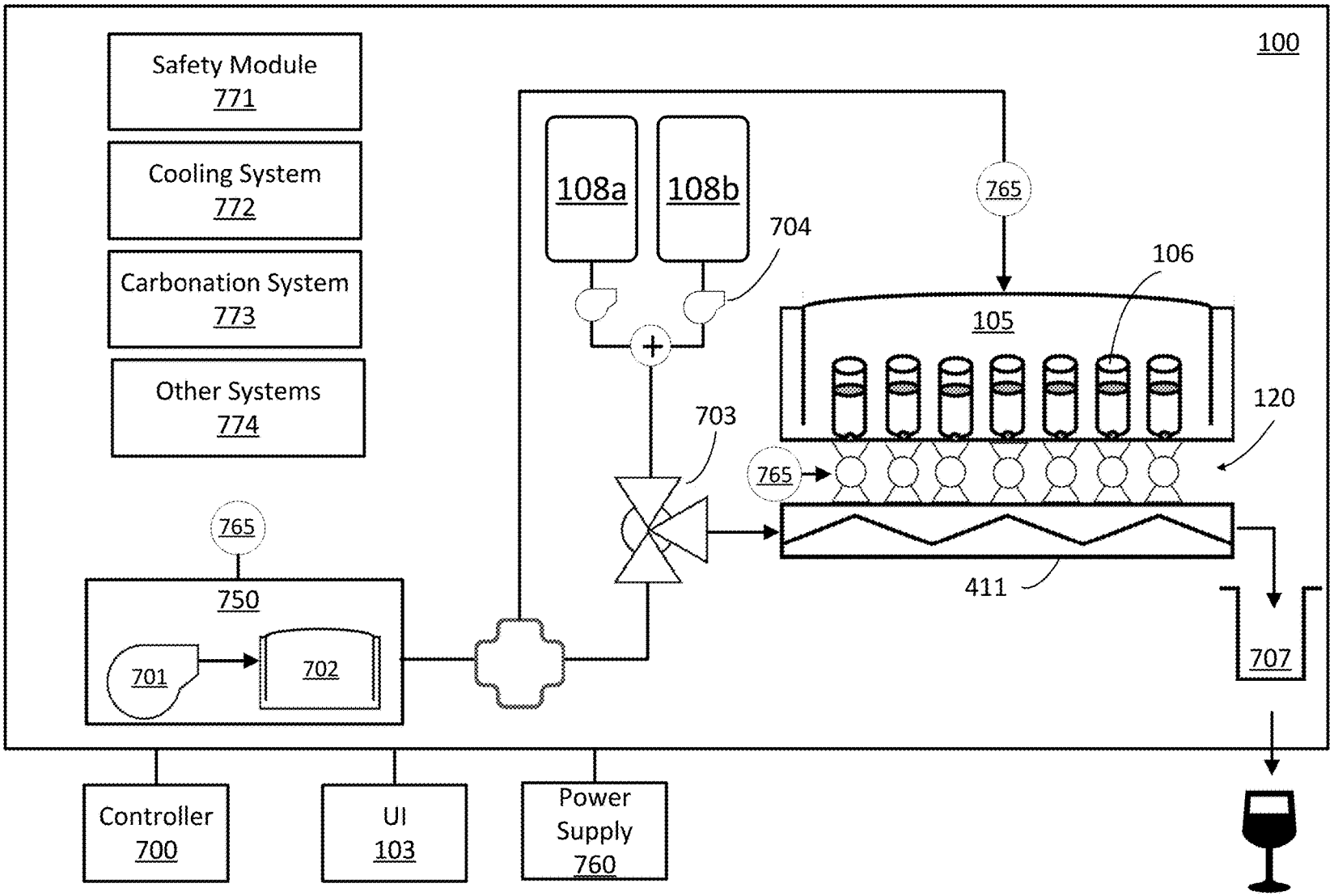
FIG. 7 illustrates a block diagram of exemplary components of a fluid mixture dispensing device, in accordance with some embodiments disclosed herein.

FIG. 7 illustrates a block diagram of exemplary components of a fluid mixture dispensing device such as device 100. FIG. 7 includes components already described in this disclosure, such as the user interface 103, the ingredient reservoirs 106 in cartridge 105, the solvent reservoirs 108*a* and 108*b*, the mixing area 411, the mixing chamber 707, and the plurality of valves such as valve 120. FIG. 7 illustrates additional exemplary components of the system, such as the controller 700 and a power supply 760, which provides power to the system, including the power to energize valves 120. FIG. 7 also illustrates various sensors 765. The sensors 765 can be pressure sensors, for example to measure a pressure of the pneumatic system 750 and/or the ingredient cartridge 105. The sensors 765 can be current sensors, for example to measure a current draw of the valves 120. This current could be sampled by the controller for various purposes such as to determine a volume dispensed through each valve based on the current draw. This and other uses of such sensors are disclosed in U.S. patent application Ser. No. 17/547,716 filed Dec. 10, 2021, and U.S. patent application Ser. No. 17/547,612 filed Dec. 10, 2021, both of which are incorporated by reference herein in their entirety for all purposes.

FIG. 7 also illustrates a pneumatic system 750. The pneumatic system can be any of the pneumatic systems disclosed in U.S. Provisional Patent Application No. 63/146,461 filed Feb. 5, 2021 and in U.S. patent application Ser. No. 17/548,258 filed Dec. 10, 2021, both of which are incorporated by reference herein in their entirety for all purposes. The pneumatic system can be used to pressurize the ingredient cartridge 105 and/or to move ingredients and solvents through the mixing area 411. This pneumatic system can include a pressure source, such as an air pump 701, and a pressure accumulator 702. The pressure source can be energized by the power supply 760 and pressurize the accumulator 702. The pressure accumulator 702 can operate as a pressure storage for the system. In this way, the pressure source 701 can be turned off when other critical tasks are being performed by the system, such as energizing the valves 120. In this way, the pneumatic system can provide pressure to the system, for example to keep the ingredient cartridge 105 pressurized during dispense, without drawing any power from the power supply 760.

FIG. 7 also illustrates various exemplary modules and subsystems of the device 100, such as a safety module 771, that can include instructions to be executed in various situations as a safety mechanism, for example to prevent overheating, to prevent over-pressurization, or other harmful conditions. FIG. 7 also illustrates a cooling system 772, a carbonation system 773 and other similar systems 774 proper to a fluid mixture dispensing device such as fluid mixture dispensing device 100. FIG. 7 also illustrates additional valves and pumps of the system 100, such as solvent pumps 704 that can be used to provide a solvent flow from the solvent reservoirs to the mixing area, and valve 703 which can be used to allow the solvent flow and/or air from the pneumatic system into the mixing area. These and other pumps, valves and components can be part of the device 100.

In specific embodiments of the invention, certain components of the device 100 can be turned to an off or idle/standby state while the valves 120 are being energized. The system can be configured to determine which components are primary components and what components are secondary components at a given moment. A primary component can be a component that cannot be turned off at the given time, and a secondary component can be a component that can be turned off at the given time. Examples of primary components with reference to FIG. 7 can include the power supply 760, the user interface 103, the safety module 771, the standby power consumption of the circuits, and/or others depending on the status of the device and the tasks being performed. In specific embodiments of the invention, the average consumption of the primary components can be about 12 W (e.g., 1 A at 12V), which can be negligible relative to the power consumption of other components of the system, such as the cooling system. Examples of secondary components can include other valves in the system which are not the ingredients dispense valves, such as valve 703, pumps such as solvent pumps 704, and systems which may not be critical to the system during the dispense time, such as the cooling system 772, the carbonation system 773, and other systems 774. In specific embodiments of the invention, approximately 288/300 available Watts are available to drive the valves when the secondary components are turned off or switched to idle/standby mode. Therefore, enough power can be available in the system to drive many valves in parallel (e.g., 188 solenoids), in theory, using the series-parallel method that will be described with reference to FIG. 8. The examples mentioned with reference to FIG. 7 as to what constitutes a primary or secondary component are for exemplary purposes only. The determination of what components are primary at a given time can be made by a controller such as controller 700 that can have a status of every component and the tasks being performed by the system. In any case, the ingredients dispense valves, such as valve 120, are primary components in that power will be prioritized for energizing such valves.

Figure 8:
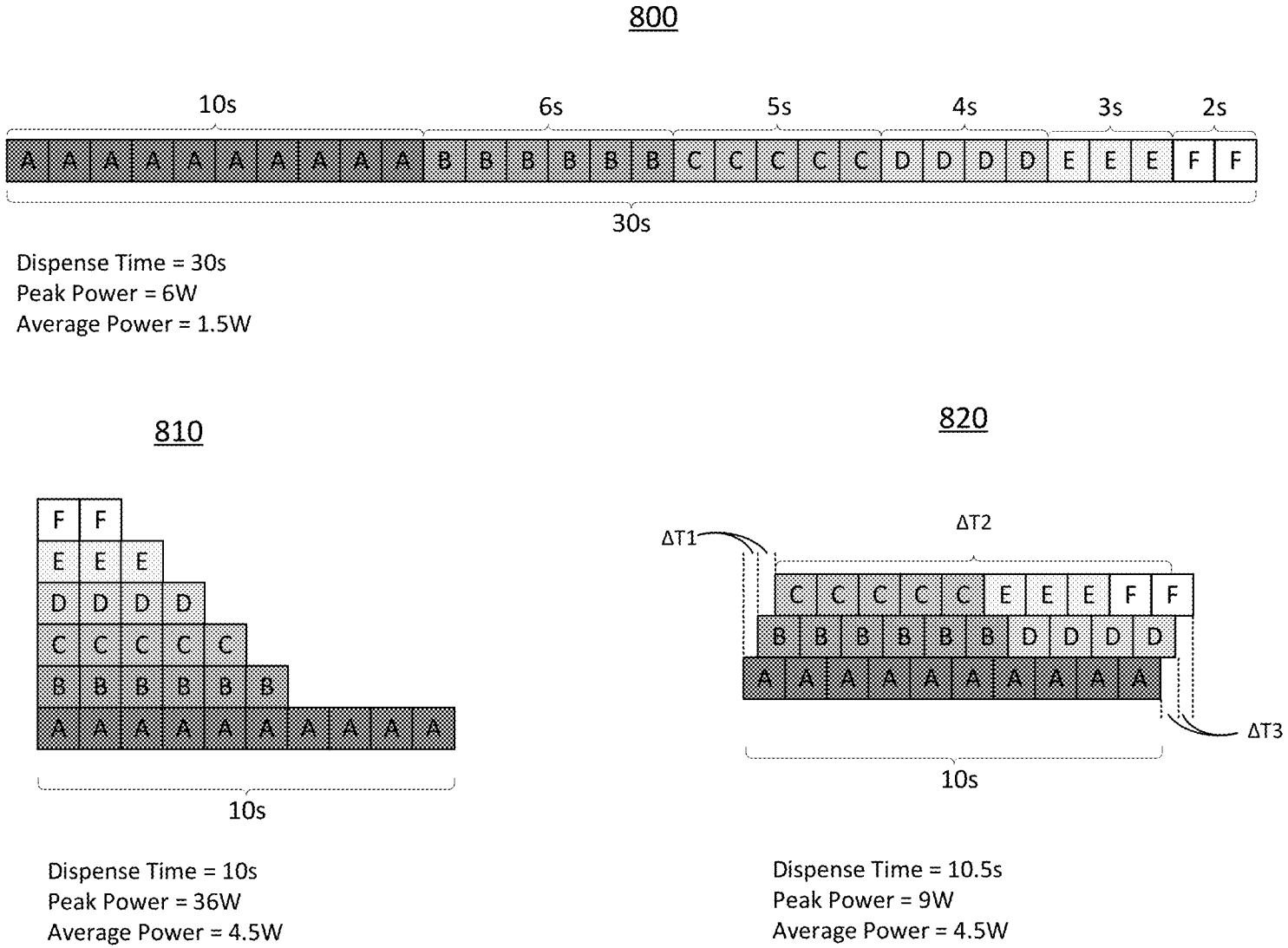
FIG. 8 illustrates a schematic representation of various dispense sequences, in accordance with some embodiments disclosed herein.

FIG. 8 illustrates schematic representations of various dispense sequences, in accordance with some embodiments disclosed herein. The time intervals, flow rates, and other values used in the example of FIG. 8 are for explicative purposes only and not a limitation of the invention. The example assumes that the power required for each valve is 6 W to open for 25 milliseconds (while the valve is being supplied with the strike current), and 1.5 W to hold for the rest of the time the valve is open (while the valve is being supplied with the hold current), which is not a limitation of the invention. The example assumes a flow rate of 1 mL/s, which is, again, not a limitation of the invention.

The representations in FIG. 8 illustrates the dispense of six different ingredients (A, B, C, D, E and F) from six different ingredient reservoirs, and through six different valves. Ingredients A, B, C, D, E and F can be ingredients of an exemplary fluid mixture which could require, for example: 10 milliliters of ingredient "A" (valve would need to be opened for 10 s); 6 milliliters of ingredient "B" (valve would need to be opened for 6 s); 5 milliliters of ingredient "C" (valve would need to be opened for 5 s); 4 milliliters of ingredient "D" (valve would need to be opened for 4 s); 3 mL of ingredient "E" (valve would need to be opened for 3 s); and 2 milliliters of ingredient ""F" (valve would need to be opened for 2 s).

Representation 800 illustrates a series dispense, in which the valves are open in series and a subsequent valve opens when the previous one closed. As illustrated in this example, it could take up to 30 s to complete the dispense of all the ingredients using this sequence. The peak dispense power could be of about 6 W, which is the strike current in this example. The average power can be about 1.5 W, given that the hold current is significantly lower than the strike current. In this example, there is neither overlapping opening times nor overlapping dispense times. Both average power and peak power requirements are significantly low, but the dispense time is significantly high. This is a cost-effective solution which could require a smaller power supply, fewest passive components, etc. However, the contribution to the overall dispense time caused by this fully serial dispensing of the ingredients may be inconvenient for a user that is in a hurry to obtain the dispensed fluid.

Representation 810 illustrates a parallel dispense, in which the valves are open simultaneously. As illustrated in this example, it could take only 10 s to complete the dispense (only the time to dispense ingredient "A", which is the ingredient to be dispensed in the largest volume). In this example, the peak dispense power would be of about 36 W, since there would be six valves striking at the same time. The average power would therefore also increase with respect to the series representation 800, to a value of 4.5 W in this example. The parallel dispense additionally has a relatively large maximum average power of 9 W for 2 s while all six ingredients are being simultaneously dispensed. In this example, there are both overlapping opening times and overlapping dispense times. The dispense time was significantly reduced in this example with respect to the series dispense 800, but power consumption increased, remarkably the peak power increased significantly. This can be a more expensive solution which would require a bigger power supply, most passive components, etc.

Representation 820 illustrates a series-parallel dispense, in which the valves have at least partially overlapping dispense times, but do not have overlapping opening times. As explained before in this disclosure, the opening times can be spaced apart by a period of time $\Delta T1$. In specific embodiments, this time can be the time that the valves take to open. In specific embodiments, and as used in the example of FIG. 8, this time can be 25 ms. In this example, valve A can be opened first since ingredient A is to be dispensed in the largest volume. After $\Delta T1$, valve B can be opened second since it is the next ingredient to be dispensed in the second largest amount. After $\Delta T1$, valve C can be opened third since it is the next ingredient to be dispensed in the third largest amount. As illustrated, valves B and C dispense without overlapping opening times with valve A, but with partially overlapping dispense times. the same process could go on for the rest of the required ingredients D, E, and F. However, as previously explained in this disclosure, the controller can have knowledge of the volume of ingredient to be dispensed and/or time that each valve has to be open for a given fluid mixture, and therefore the controller can determine not only the order in which to open the valves (such as A, B and C opened based on which will dispense the most/take more time to dispense), but also determine opening times so that power is minimized without significant impact in the overall dispense time. In representation 821, valve D can be opened fourth since it is the next ingredient to be dispensed in the fourth largest amount. However, the controller can determine possible combinations of valves that will lead to a more efficient dispense. In the example of representation 820, valve E is open fourth and followed by valve F, which combined would require more time than valve D alone. These and other multiple determinations can be made by the controller to decide the order for opening the valves.

In the example of representation 820, the valves do not have overlapping opening times, and do have partially overlapping dispense times with at least one other valve. The dispense time in this example would be of about 10.05 s, which is considerably close to the minimum dispense time that could be accomplished in the parallel dispense of representation 810. This dispense time is largely due to the minimum time required to dispense ingredient A, which is the ingredient to be dispensed in the largest volume.

Comparing the series-parallel approach of representation 820 with the fully parallel dispense of representation 810 provides insights into the benefits of a series-parallel approach. First, the dispense time is increased by only 0.05 s due to the variations of opening times of the valves which may be an imperceptible difference to the average user. Second, the average power consumption, is approximately the same (4.5 W) as for the parallel dispense of representation 800. Third, the peak power decreased dramatically to 9 W with respect to the parallel dispense. Representation 820 illustrates how in specific implementations a series-parallel approach can improve the power performance of the dispense with minimal impact on the dispense time of the device.

As evidenced by the example of FIG. 8, the valve sequencing of specific embodiments of the invention can provide the benefits of both the series dispense (by not having overlapping opening times) and the parallel dispense (by having partially overlapping dispense times). In this way, both power and dispense time can be optimized. More specifically, peak power is reduced so that the power budget of the system can accommodate the dispense and other components at the same time. This solution can retain dispense times that are nearly as short as for the parallel dispense approach and at the same time even out power consumption.

In specific embodiments of the invention, an algorithm to implement the series-parallel solution, such as that of representation 820, can be as follows. First the power budget for the system can be taken as a given. Then the number of parallel dispenses that can be supported can be solved for using the equation Total Power=Strike Power+Hold Power (Number of Dispenses−1). As an example, with a power budget of 12 W taken as a given, a strike power of 6 W, and a hold power of 1.5 W, this calculation could be: (12 W−6 W)/1.5 W+1=5. The algorithm can also include striking one valve at a time, for example the one associated with the longest required dispense time first and continuing in order according to the next longest required dispense time. The algorithm can further include continuing to strike additional valves so long as any unused parallel channel is available and no other valve is currently being struck. The algorithm can continue until the dispense is complete.

A controller, as used in this disclosure for example with reference to controller 700, can include one or more processors that can be distributed locally within the system or remotely. For example, one or more components of the system, such as valves, pumps, and sensors can be associated to individual microcontrollers that can control their operations and interaction with other components of the system. In specific embodiments of the invention, the controller can be a control system for the overall device even if the various control elements are separately programmed and are not part of a common control hierarchy. The controller can have access to one or more memories that store the instructions for the controllers. The memories can also store information for the system, such as a library of recipes, reference values such as the pressure thresholds and/or target pressure values mentioned in this disclosure, and any other necessary information such as sensor data and the like.

While the specification has been described in detail with respect to specific embodiments of the invention, it will be appreciated that those skilled in the art, upon attaining an understanding of the foregoing, may readily conceive of alterations to, variations of, and equivalents to these embodiments. Any of the method disclosed herein can be executed by a processor in combination with a computer readable media storing instructions for the methods in combination with the other hardware elements described above. These and other modifications and variations to the present invention may be practiced by those skilled in the art, without departing from the scope of the present invention, which is more particularly set forth in the appended claims.

What is claimed is:

1. A fluid mixture dispensing device comprising:

a mixing area;

a set of ingredient reservoirs;

a set of electromechanical valves, wherein the set of electromechanical valves: (i) are in a one-to-one correspondence with the set of ingredient reservoirs, and (ii) fluidly connect the set of ingredient reservoirs and the mixing area during a respective set of dispense times;

a controller programmed to actuate at least two valves from the set of electromechanical valves to dispense, to the mixing area, at least two ingredients from the set of ingredient reservoirs associated with the at least two valves; and a current sensor configured to measure a current draw of the electromechanical valves in the set of electromechanical valves;

wherein the controller is programmed to actuate the at least two valves in sequence with partially overlapping dispense times and without overlapping opening times; and wherein the controller is further programmed to:

sample the current draw from the current sensor; and determine a volume dispensed through each valve based on the current draw.

2. The fluid mixture dispensing device of claim 1, wherein the electromechanical valves in the set of electromechanical valves are solenoid valves.

3. The fluid mixture dispensing device of claim 1, further comprising:

a set of primary components; and a set of secondary components;

wherein the set of primary components includes the set of electromechanical valves; and wherein the controller is configured to turn off the set of secondary components while the electromechanical valves are dispensing the at least two ingredients from the set of ingredient reservoirs.

4. The fluid mixture dispensing device of claim 3, wherein:

the set of primary components comprises at least one of: a power supply, a safety mechanism, and a user interface.

5. The fluid mixture dispensing device of claim 3, wherein:

the set of secondary components comprises at least one of: a pump, a valve, a cooling system, and a carbonating system.

6. The fluid mixture dispensing device of claim 1, wherein the controller is further programmed to:

obtain a volume to be dispensed of each of the at least two ingredients; and actuate the at least two valves so that a valve associated with an ingredient to be dispensed in a larger volume is opened first.

7. The fluid mixture dispensing device of claim 1, wherein the controller is further programmed to:

open a first valve of the at least two valves at a first opening time; and open a second valve of the at least two valves at a second opening time;

wherein the second opening time is at least 25 milliseconds later than the first opening time.

8. The fluid mixture dispensing device of claim 1, wherein the controller is further programed to:

hold the at least two valves open for an individually customizable dispense time;

wherein the controller is programmed to individually customize a dispense time for each of the at least two valves based on a volume to be dispensed of each of the at least two ingredients.

9. The fluid mixture dispensing device of claim 1, wherein the controller is programed to:

open a first valve of the at least two valves at a first opening time;

hold the first valve open for a first dispense time;

open a second valve of the at least two valves at a second opening time; and hold the second valve open for a second dispense time;

wherein the controller is programmed to determine based on stored information for the at least two ingredients and a recipe for a fluid mixture to be prepared by the fluid mixture dispensing device:

an order of the first opening time and the second opening time; and a duration of the first dispense time and the second dispense time.

10. The fluid mixture dispensing device of claim 9, wherein the determination is made based on a volume to be dispensed of each of the at least two ingredients.

11. The fluid mixture dispensing device of claim 1, wherein the controller is programed to:

open the at least two valves in an order;

wherein the order is determined by at least one of: (i) a respective ingredient dispense time for each valve in the at least two valves; and (ii) a respective ingredient dispense volume for each valve in the at least two valves.

12. The fluid mixture dispensing device of claim 1, wherein the controller is further programmed to:

receive instructions to dispense, for each of the at least two ingredients, a respective volume;

associate the respective volume to a respective dispense time for each of the at least two valves associated with the at least two ingredients; and dispense the respective volume of each of the at least two ingredients by keeping the at least two valves open for the respective dispense times.

13. A method for a fluid mixture dispensing device, the method comprising:

actuating, by a controller of the fluid mixture dispensing device, at least two valves from a set of electromechanical valves;

dispensing, by the at least two valves and in response to the actuating, at least two ingredients from a set of ingredient reservoirs associated with the at least two valves to a mixing area;

measuring, using a current sensor, a current draw of the electromechanical valves in the set of electromechanical valves;

sampling the current draw from the current sensor; and determining a volume dispensed through each valve based on the current draw;

wherein the set of electromechanical valves: (i) are in a one-to-one correspondence with the set of ingredient reservoirs, and (ii) fluidly connect the set of ingredient reservoirs and the mixing area during a respective set of dispense times; and wherein the controller actuates the at least two valves in sequence with partially overlapping dispense times and without overlapping opening times.

14. The method of claim 13, wherein the electromechanical valves in the set of electromechanical valves are solenoid valves.

15. The method of claim 13, wherein:

the fluid mixture dispensing device comprises: (i) a set of primary components; and (ii) a set of secondary components;

the set of primary components includes the set of electromechanical valves; and the method further comprises:

turning off the set of secondary components while the electromechanical valves are dispensing the at least two ingredients from the set of ingredient reservoirs.

16. The method of claim 15, wherein:

the set of primary components comprises at least one of: a power supply, a safety mechanism, and a user interface.

17. The method of claim 15, wherein:

the set of secondary components comprises at least one of: a pump, a valve, a cooling system, and a carbonating system.

18. The method of claim 13, further comprising:

determining a volume to be dispensed of each of the at least two ingredients; and actuating the at least two valves so that a valve associated with an ingredient to be dispensed in a larger volume is opened first.

19. The method of claim 13, further comprising:

opening a first valve of the at least two valves at a first opening time; and opening a second valve of the at least two valves at a second opening time;

wherein the second opening time is at least 25 milliseconds later than the first opening time.

20. The method of claim 13, further comprising:

holding the at least two valves open for an individually customizable dispense time; and individually customizing a dispense time for each of the at least two valves based on a volume to be dispensed of each of the at least two ingredients.

21. The method of claim 13, further comprising:

determining, based on stored information for the at least two ingredients and a recipe for a fluid mixture to be prepared by the fluid mixture dispensing device:

(i) an order of a first opening time and a second opening time; and (ii) a duration of a first dispense time and a second dispense time;

opening a first valve of the at least two valves at the first opening time;

holding the first valve open for the first dispense time;

opening a second valve of the at least two valves at the second opening time; and holding the second valve open for the second dispense time.

22. The method of claim 21, wherein the determining is made based on a volume to be dispensed of each of the at least two ingredients.

23. The method of claim 21, wherein the first dispense time and the second dispense time partially overlap.

24. The method of claim 13, further comprising:

opening the at least two valves in an order;

wherein the order is determined by a respective volume of ingredient to be dispensed by each valve.

25. The method of claim 13, further comprising:

receiving instructions to dispense, for each of the at least two ingredients, a respective volume;

associating the respective volume to a respective dispense time for each of the at least two valves associated with the at least two ingredients; and dispensing the respective volume of each of the at least two ingredients by keeping the at least two valves open for the respective dispense times.

26. A fluid mixture dispensing device comprising:

a mixing area;

a set of ingredient reservoirs;

a set of electromechanical valves, wherein the set of electromechanical valves: (i) are in a one-to-one correspondence with the set of ingredient reservoirs, and (ii) fluidly connect the set of ingredient reservoirs and the mixing area during a respective set of dispense times;

a power supply that provides power to the electromechanical valves;

a pneumatic system that receives power from the power supply; and a controller programmed to actuate at least two valves from the set of electromechanical valves to dispense, to the mixing area, at least two ingredients from the set of ingredient reservoirs associated with the at least two valves;

wherein the controller is programmed to actuate the at least two valves in sequence with partially overlapping dispense times and without overlapping opening times; and wherein during the dispense of the at least two ingredients, the ingredient reservoirs in the set of ingredient reservoirs are pressurized by the pneumatic system and the pneumatic system does not draw any power from the power supply.

27. A method for a fluid mixture dispensing device, the method comprising:

providing power, by a power supply, to a set of electromechanical valves;

providing power, by the power supply, to a pneumatic system;

actuating, by a controller of the fluid mixture dispensing device, at least two valves from the set of electromechanical valves; and dispensing, by the at least two valves and in response to the actuating, at least two ingredients from a set of ingredient reservoirs associated with the at least two valves to a mixing area;

wherein the set of electromechanical valves: (i) are in a one-to-one correspondence with the set of ingredient reservoirs, and (ii) fluidly connect the set of ingredient reservoirs and the mixing area during a respective set of dispense times;

wherein the controller actuates the at least two valves in sequence with partially overlapping dispense times and without overlapping opening times; and wherein, during the dispensing of the at least two ingredients, the ingredient reservoirs in the set of ingredient reservoirs are pressurized by the pneumatic system and the pneumatic system does not draw any power from the power supply.

* * * * *